US007600389B2

(12) United States Patent
Kim et al.

(10) Patent No.: US 7,600,389 B2
(45) Date of Patent: Oct. 13, 2009

(54) MULTI-UNIT AIR CONDITIONER AND METHOD FOR CONTROLLING THE SAME

(75) Inventors: Ki Bum Kim, Seoul (KR); Il Nahm Hwang, Yongin-si (KR); Pil Hyun Yoon, Seoul (KR); Do Yong Ha, Anyang-si (KR); Young Min Park, Incheon-si (KR)

(73) Assignee: LG Electronics Inc., Seoul (KR)

( * ) Notice: Subject to any disclaimer, the term of this patent is extended or adjusted under 35 U.S.C. 154(b) by 520 days.

(21) Appl. No.: 11/194,440

(22) Filed: Aug. 2, 2005

(65) Prior Publication Data

US 2006/0123815 A1 Jun. 15, 2006

(30) Foreign Application Priority Data

Dec. 14, 2004 (KR) ..... 10-2004-0105331

(51) Int. Cl.
*F25B 5/00* (2006.01)

(52) U.S. Cl. ..... 62/200; 62/199

(58) Field of Classification Search ..... 62/200, 62/199, 324.1; 236/51
See application file for complete search history.

(56) References Cited

U.S. PATENT DOCUMENTS

| | | | | |
|---|---|---|---|---|
| 5,107,684 | A * | 4/1992 | Nakayama et al. | 62/81 |
| 6,735,973 | B2 | 5/2004 | Lee | |
| 6,883,345 | B2 | 4/2005 | Lee | |
| 2003/0226367 | A1 * | 12/2003 | Palmer et al. | 62/149 |
| 2005/0076657 | A1 | 4/2005 | Kim | |

FOREIGN PATENT DOCUMENTS

| | | | |
|---|---|---|---|
| CN | 1291702 | | 4/2001 |
| CN | 1431434 | | 7/2003 |
| CN | 1515843 | | 7/2004 |
| CN | 2628969 | | 7/2004 |
| JP | 1-196462 | | 8/1989 |
| JP | 2002156166 | A * | 5/2002 |
| KR | 06-213524 | | 8/1994 |

OTHER PUBLICATIONS

English language Abstract of CN 1515843.
English language Abstract of CN 1434134.
English language Abstract of JP 1-196462.
English language Abstract of CN 1291702.
English language Abstract of KR 06-213524.

* cited by examiner

*Primary Examiner*—Chen-Wen Jiang
(74) *Attorney, Agent, or Firm*—McKenna Long & Aldridge LLP

(57) ABSTRACT

A multi-unit air conditioner and a method for controlling the same are disclosed which are capable of preventing continuous introduction of a refrigerant into indoor units in an OFF state where the indoor units can be independently powered on or off, thereby preventing a degradation in the cooling and heating efficiencies. The air conditioner includes a plurality of indoor units each including a power controller adapted to independently power on or off an associated one of the indoor units, an outdoor unit connected with the indoor units, the outdoor unit including a microcomputer for controlling an operation of the outdoor unit, and enabling the outdoor unit to communicate with the indoor units, and a controller for determining whether each of the indoor units is in a normal operation state or in a non-operation state, and controlling an operation of a distributor in accordance with the result of the determination.

12 Claims, 3 Drawing Sheets

MULTI-UNIT AIR CONDITIONER AND METHOD FOR CONTROLLING THE SAME

This application claims the benefit of Korean Patent Application No. 10-2004-0105331, filed on Dec. 14, 2004, which is hereby incorporated by reference as if fully set forth herein.

BACKGROUND OF THE INVENTION

1. Field of the Invention

The present invention relates to an air conditioner, and more particularly, to a multi-unit air conditioner and a method for controlling the same which are capable of preventing continuous introduction of a refrigerant into an indoor unit or indoor units in an OFF state, thereby preventing a degradation in the cooling and heating efficiencies of the air conditioner.

2. Discussion of the Related Art

Generally, air conditioners perform procedures of compressing, condensing, expanding and evaporating a refrigerant to cool and/or heat a confined space. Such air conditioners are classified into a cooling type wherein a refrigerant flows only in one direction through a refrigerant cycle, to supply cold air to a confined space, and a cooling and heating type wherein a refrigerant flows bi-directionally in a selective manner through a refrigerant cycle, to selectively supply cold air or hot air to a confined space.

Also, such air conditioners are classified into a general type wherein one indoor unit is connected to one outdoor unit, and a multi-unit type wherein a plurality of indoor units are connected to one outdoor unit. For the multi-unit type, an air conditioner may be implemented which includes at least one outdoor unit.

Multi-unit air conditioners are classified into a switching type wherein all indoor units operate in the same operating mode, that is, in cooling mode or heating mode alone, and a simultaneous type wherein a part of the indoor units operate in cooling mode, and the remaining indoor unit or indoor units operate in heating mode.

In such a multi-unit air conditioner, a controller is provided at each of the indoor units and outdoor unit. Through communications between a microcomputer included in the controller of the outdoor unit and a microcomputer included in the controller of each indoor unit, the outdoor unit controls the indoor unit. Also, each indoor unit is electrically connected in parallel with the outdoor unit such that the outdoor unit and indoor units are simultaneously powered on or off. The outdoor unit also controls the power ON/OFF of each indoor unit.

An electronic expansion valve is arranged in a refrigerant line extending to each indoor unit, in order to prevent the refrigerant from entering the indoor unit when the indoor unit does not operate. When the indoor unit operates, the electronic expansion valve allows introduction of the refrigerant into the indoor unit, and reduces the pressure of the refrigerant to expand the refrigerant to a low-temperature and low-pressure mist state.

Meanwhile, if necessary, power controllers may be installed in the indoor units, respectively, in order to individually control the power ON/OFF of the indoor units. In this case, however, there may be a problem in that, when a fraction of the indoor units are powered off during operation of the air conditioner, the electronic expansion valves connected to the powered-off indoor units can be no longer controlled from an open state thereof.

That is, when one indoor unit is powered off during operation of the air conditioner, the electronic expansion valve connected to the indoor unit can be no longer controlled from an open state thereof, so that the refrigerant is continuously introduced into the powered-off indoor unit. In this case, the performance of the other indoor units, which operate normally, is degraded, thereby causing a degradation in cooling and heating efficiencies. Furthermore, since no heat exchange is carried out in the powered-off indoor unit, the refrigerant, which does not perform heat exchange in the powered-off indoor unit, is introduced into a compressor. As a result, a degradation in the performance of the air conditioner occurs.

SUMMARY OF THE INVENTION

Accordingly, the present invention is directed to a multi-unit air conditioner and a method for controlling the same that substantially obviate one or more problems due to limitations and disadvantages of the related art.

An object of the present invention is to provide a multi-unit air conditioner system capable of recovering a refrigerant from powered-off one or ones of the indoor units included in the multi-unit air conditioner, and cutting off the refrigerant supplied to the powered-off indoor unit or units, thereby preventing a degradation in the performance of the air conditioner.

Another object of the present invention is to provide a multi-unit air conditioner system capable of achieving an enhancement in cooling and heating performance.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a multi-unit air conditioner comprising: a plurality of indoor units each comprising a power controller adapted to independently power on or off an associated one of the indoor units; an outdoor unit connected with the indoor units, the outdoor unit comprising a microcomputer for controlling an operation of the outdoor unit, and enabling the outdoor unit to communicate with the indoor units; and at least one controller for determining whether each of the indoor units is in a normal operation state or in a non-operation state, and controlling an operation of a distributor in accordance with the result of the determination.

The at least one controller may be installed in at least one of the outdoor unit and the distributor, respectively.

The distributor may comprise at least one first intermittent valve arranged in a refrigerant line through which a refrigerant is introduced into the indoor units, and at least one second intermittent valve arranged in a refrigerant line through which the refrigerant from the indoor units is discharged into the outdoor unit.

Each of the first and second intermittent valves may be a solenoid valve controlled by the controller or by the microcomputer of the outdoor unit. The at least one first intermittent valve may comprise a plurality of first intermittent valves respectively arranged in branch refrigerant lines, through each of which the refrigerant is introduced into an associated one of the indoor units. The at least one second intermittent valve may comprise a plurality of second intermittent valves respectively arranged in branch refrigerant lines, through each of which the refrigerant from an associated one of the indoor units is discharged into the outdoor unit.

In another aspect of the present invention, a multi-unit air conditioner comprises: a plurality of indoor units; an outdoor unit connected with the indoor units, the outdoor unit comprising a microcomputer for controlling an operation of the outdoor unit, and enabling the outdoor unit to communicate with the indoor units; an electronic expansion valve arranged in a refrigerant line through which a refrigerant from the outdoor unit is introduced into the indoor units; first intermittent valves arranged in a refrigerant line through which the refrigerant is introduced into the indoor units; second intermittent valves arranged in a refrigerant line through which the refrigerant from the indoor units is discharged into the outdoor unit; and at least one controller for determining whether each of the indoor units is in a normal operation state or in a non-operation state, and controlling an operation of a distributor in accordance with the result of the determination, the at least one controller being arranged in at least one of the outdoor unit and a distributor, respectively.

The electronic expansion valve may comprise sub electronic expansion valves respectively arranged in branch refrigerant lines, through each of which the refrigerant is introduced into an associated one of the indoor units, and a main electronic expansion valve arranged in the refrigerant line, through which the refrigerant is introduced into the indoor units, and which is branched into the branch refrigerant lines.

In particular, each of the first intermittent valves may be arranged between an associated one of the sub electronic expansion valves and the indoor unit associated with the associated sub electronic expansion valve. The electronic expansion valve and the first and second intermittent valves may be controlled by the microcomputer of the outdoor unit. Each of the first and second intermittent valves may be a solenoid valve controlled by the microcomputer of the outdoor unit or by the controller.

In another aspect of the present invention, a method for controlling a multi-unit air conditioner including an outdoor unit and a plurality of indoor units, comprising the steps of: checking a communication state established between the outdoor unit and each of the indoor units; determining whether or not there is a powered-off one of the indoor units under a condition in which a communication state is established between the outdoor unit and each of the indoor units; recovering a refrigerant from the powered-off indoor unit; and cutting off the refrigerant supplied to the powered-off indoor unit.

The determining step may comprise the step of determining one of the indoor units, which does not provide a response to the outdoor unit for a predetermined response time, as the powered-off indoor unit. The predetermined response time may be 5 minutes.

The refrigerant recovering step may comprise the steps of closing a first intermittent valve arranged in an inlet refrigerant line of the powered-off indoor unit, and operating the powered-off indoor unit for a predetermined time, thereby recovering the refrigerant from the powered-off indoor unit.

The refrigerant cutting-off step may comprise the steps of closing first and second intermittent valves respectively arranged in inlet and outlet refrigerant lines of the powered-off indoor unit.

The method may further comprise the step of executing a normal operation of the air conditioner after execution of the refrigerant cutting-off step.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
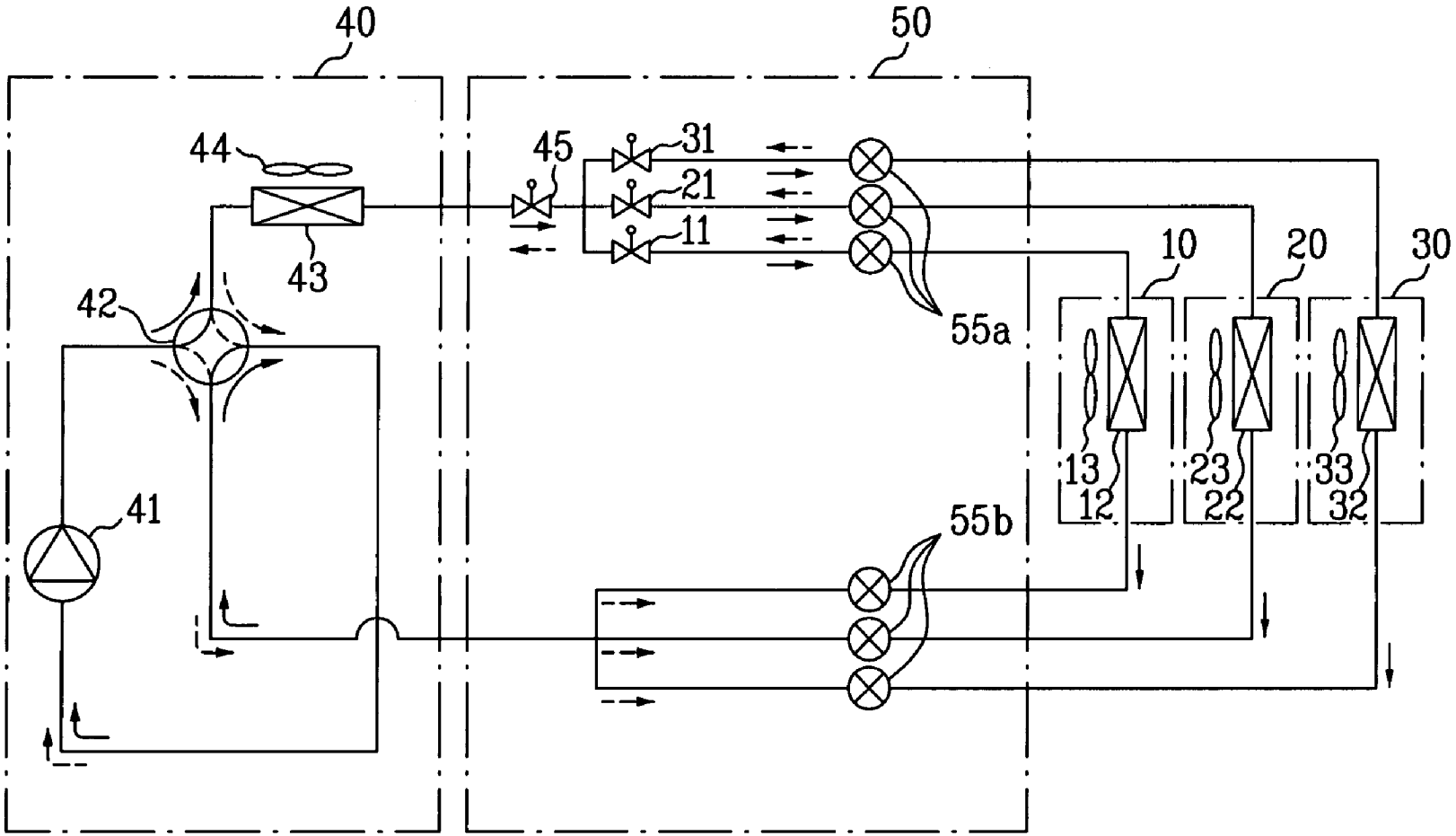
FIG. 1 is a schematic view illustrating a configuration of a multi-unit air conditioner according to an embodiment of the present invention.

FIG. 1 is a schematic view illustrating a configuration of a multi-unit air conditioner according to an embodiment of the present invention.

As shown in FIG. 1, the multi-unit air conditioner (hereinafter, simply referred to as an "air conditioner") includes an outdoor unit 40 installed outdoors, and a plurality of indoor units, that is, an indoor unit 10 for a room A, an indoor unit 20 for a room B, and an indoor unit 30 for a room C, installed indoors. The indoor units 10, 20, and 30 are connected to the outdoor unit 40 so that they operate as a single system.

Figure 2:
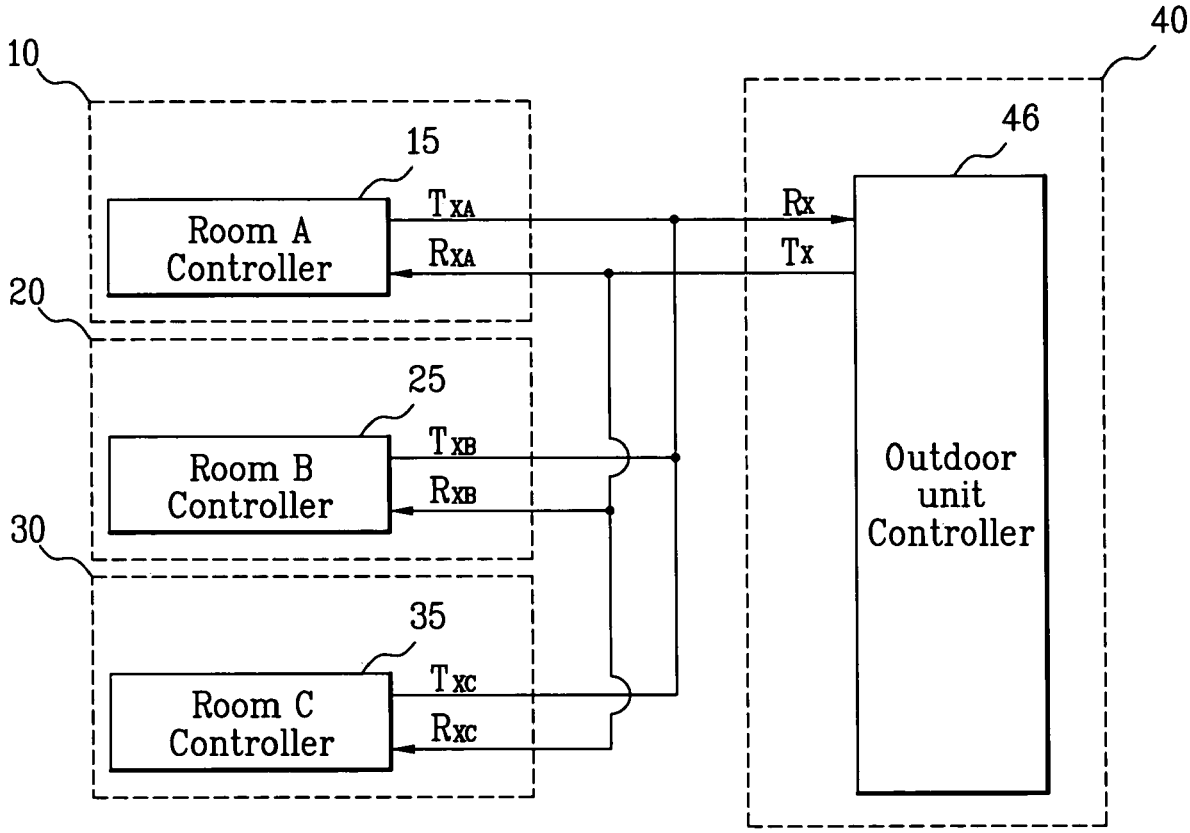
FIG. 2 is a block diagram illustrating an example of a communication controlling apparatus in the multi-unit air conditioner according the embodiment of the present invention.

As shown in FIG. 2, the outdoor unit 40 includes a compressor 41 for compressing a refrigerant to a high-temperature and high-pressure gas state, and an outdoor heat exchanger 43 for condensing the refrigerant gas, compressed to a high-temperature and high-pressure state in the compressor 41, into a low-temperature and high-pressure liquid state. The outdoor unit 40 also includes a 4-way valve 42, a main electronic expansion valve 45, and room-A, B, and C electronic expansion valves 11, 21, and 31 (hereinafter, simply referred to as "sub electronic expansion valves").

An outdoor fan 44 is arranged at one side of the outdoor heat exchanger 43. The outdoor fan 44 sucks outdoor air, and blows the sucked air toward the outdoor heat exchanger 43, in order to enable the outdoor heat exchanger 43 to perform effective heat exchange.

The 4-way valve 42 changes the flow path of the refrigerant gas compressed to a high-temperature and high-pressure state in the compressor 41 in accordance with the operation mode (cooling mode or heating mode) of the air conditioner.

The main electronic expansion valve 45 controls the temperature of the refrigerant discharged from the outdoor heat exchanger 43 to control the over-heating degree in the cooling mode and the over-cooling degree in the heating mode.

Each of the sub electronic expansion valves 11, 21, and 31 is opened or closed under control of a controller (not shown) in order to enable the associated indoor unit 10, 20 or 30 to selectively perform an air conditioning operation for the associated room in accordance with the operation condition of the associated indoor unit 10, 20 or 30. That is, the sub electronic expansion valves 11, 21, or 31 distribute the refrigerant supplied through the main electronic expansion valve 45, and selectively cut off the refrigerant supplied to the indoor units 10, 20, and 30, respectively. In particular, each of the sub electronic expansion valves 11, 21, and 31 receives the low-temperature and high-pressure refrigerant liquid cooled and condensed in the outdoor unit 43, and reduces the pressure of the received refrigerant to expand the refrigerant to an easily-evaporable low-temperature and low-pressure mist state.

The indoor units 10, 20, and 30 include respective indoor heat exchangers 12, 22, and 32 for evaporating the low-temperature and low-pressure misty refrigerant emerging from respective sub electronic expansion valves 11, 21, and 31, thereby changing the refrigerant to a low-temperature and low-pressure pure gas state. The indoor units 10, 20, and 30 also include indoor fans 13, 23, and 33 for circulating indoor air to enable the indoor heat exchangers 12, 22, and 32 to effectively perform heat exchange, respectively.

First intermittent valves 55*a* are arranged in first refrigerant lines, through each of which the refrigerant from the outdoor unit 40 is introduced into an associated one of the indoor units 10, 20, and 30, in order to cut off the refrigerant introduced into the indoor unit 10, 20, and 30, respectively. Second intermittent valves 55*b* are arranged in second refrigerant lines, through each of which the refrigerant from an associated one of the indoor units 10, 20, and 30 is discharged into the outdoor unit 40, in order to cut off the refrigerant discharged from the indoor units 10, 20, and 30, respectively. The first intermittent valves 55*a* and second intermittent valves 55*b* constitute a distributor 50, together with a microcomputer (not shown) adapted to control the intermittent valves 55*a* and 55*b*. It is preferred that each of the first and second intermittent valves 55*a* and 55*b* be a solenoid valve.

Meanwhile, the microcomputer may also be arranged in the distributor 50, in addition to the outdoor unit 40.

When the indoor units 10, 20, and 30 operate in cooling mode in the air conditioner having the above-described configuration, the 4-way valve 42 is in an OFF state. In this case, accordingly, a refrigerant cycle is established in which the refrigerant flows along the path as indicated by solid-line arrows in FIG. 2.

This will be described in more detail. First, the high-temperature and high-pressure refrigerant gas discharged from the compressor 41 of the outdoor unit 40 is introduced into the outdoor heat exchanger 43 through the 4-way valve 42. The introduced refrigerant heat-exchanges with air, blown to the outdoor heat exchanger 43 by the outdoor fan 44, in the outdoor heat exchanger 43. That is, the compressed high-temperature and high-pressure refrigerant gas is forcibly cooled and condensed to a low-temperature and high-pressure liquid state.

The low-temperature and high-pressure refrigerant liquid discharged from the outdoor heat exchanger 43 is introduced into the sub electronic expansion valves 11, 21, and 31 via the main electronic expansion valve 45. As a result, the refrigerant is expanded to an easily-evaporable low-temperature and low-pressure mist state. The refrigerant is then introduced into the indoor heat exchangers 12, 22, and 32 of the indoor units 10, 20, and 30. In each of the indoor heat exchangers 12, 22, and 32, the pressure-reduced low-temperature and low-pressure misty refrigerant absorbs heat from air, blown to the associated indoor heat exchanger 12, 22, or 32 by the associated indoor fan 13, 23, or 33, while being evaporated, thereby cooling the air. The cooled air is discharged to the rooms to reduce the temperatures of the rooms. Thus, the air conditioner operates in cooling mode.

The low-temperature and low-pressure refrigerant gas evaporated in the indoor heat exchangers 12, 22, and 32 is introduced again into the compressor 41, and is then changed to a high-temperature and high-pressure refrigerant gas state. Thus, the above-described refrigerant cycle is repeated.

The main electronic expansion valve 45 performs an overheating degree control operation in accordance with the operation conditions of the indoor units 10, 20, and 30. Each of the sub electronic expansion valves 11, 21, and 31 distributes the refrigerant to the associated indoor unit 10, 20, or 30 when the associated indoor unit 10, 20, or 30 operates, and cuts off the refrigerant distributed to the associated indoor unit 10, 20, or 30 when the associated indoor unit 10, 20, or 30 does not operate.

Meanwhile, when the indoor units 10, 20, and 30 operate in heating mode, the 4-way valve 42 is in an ON state. In this case, accordingly, a refrigerant cycle is established in which the refrigerant flows along the path as indicated by dotted-line arrows in FIG. 2.

In this case, first, the high-temperature and high-pressure refrigerant gas discharged from the compressor 41 of the outdoor unit 40 is introduced into the indoor heat exchangers 12, 22, and 32 of the indoor units 10, 20, and 30 through the 4-way valve 42. Accordingly, the indoor heat exchangers 12, 22, and 32 operate in heating mode. That is, each indoor heat exchanger 12, 22, or 32 heat exchanges with air blown by the associated indoor fan 13, 23, or 33, thereby releasing heat to the air, and thus, heating the air. The heated air is discharged to the associated room. At this time, the refrigerant is cooled to an ambient-temperature and high-pressure liquid state.

The refrigerant liquefied in each of the indoor heat exchangers 12, 22, and 32 is introduced into the associated sub electronic expansion valve 11, 21, or 31, and is then pressure-reduced to expand to an easily-evaporable low-temperature and low-pressure mist state. The refrigerant is subsequently introduced into the outdoor heat exchanger 43 via the main electronic expansion valve 45.

In the outdoor heat exchanger 43, the low-temperature and low-pressure misty refrigerant heat-exchanges with air blown by the outdoor fan 44, so that the refrigerant is cooled to a low-temperature and low-pressure gas state. Thus, the above-described refrigerant cycle is repeated.

The main electronic expansion valve 45 performs an overcooling degree control operation in accordance with the operation conditions of the indoor units 10, 20, and 30. Each of the sub electronic expansion valves 11, 21, and 31 distributes the refrigerant to the associated indoor unit 10, 20, or 30 when the associated indoor unit 10, 20, or 30 operates, and cuts off the refrigerant distributed to the associated indoor unit 10, 20, or 30 when the associated indoor unit 10, 20, or 30 does not operate.

FIG. 2 is a block diagram illustrating an example of a communication controlling apparatus in the multi-unit air conditioner according the illustrated embodiment of the present invention.

The operation of the air conditioner is controlled through control signal communications between an outdoor unit controller 46 constituted by a microcomputer installed in the outdoor unit 40 and room-A, B, and C controllers 15, 25, and 35 respectively constituted by microcomputers installed in the indoor units 10, 20, and 30.

That is, when an operation key on an operating panel installed in the room-A indoor unit 10 is pressed, the room-A controller 15 receives an operation signal, and performs a control operation for drivers (for example, an indoor fan driver, a blowing direction driver, an indoor temperature sensor, an indoor conduit temperature sensor, and the like) required in the room-A indoor unit 10, in accordance with the operation signal. The room-A controller 15 also outputs a communication control signal to the outdoor unit controller 46, so as to enable the outdoor unit controller 46 to perform a control operation for the compressor 41, 4-way valve 42, outdoor fan 44, main electronic expansion valve 45, and the like.

The control operations carried out by the room-B and C indoor units 20 and 30 are identical to the above-described control operation carried out by the room-A indoor unit 10.

Meanwhile, the indoor units 10, 20, and 30 are electrically connected with the outdoor unit 40 in parallel such that the indoor units 10, 20, and 30, and the outdoor unit 40 are simultaneously powered on or off. If necessary, each of the indoor units 10, 20, and 30 may includes a power ON/OFF device adapted to independently power on or off the associated indoor unit 10, 20, or 30.

Figure 3:
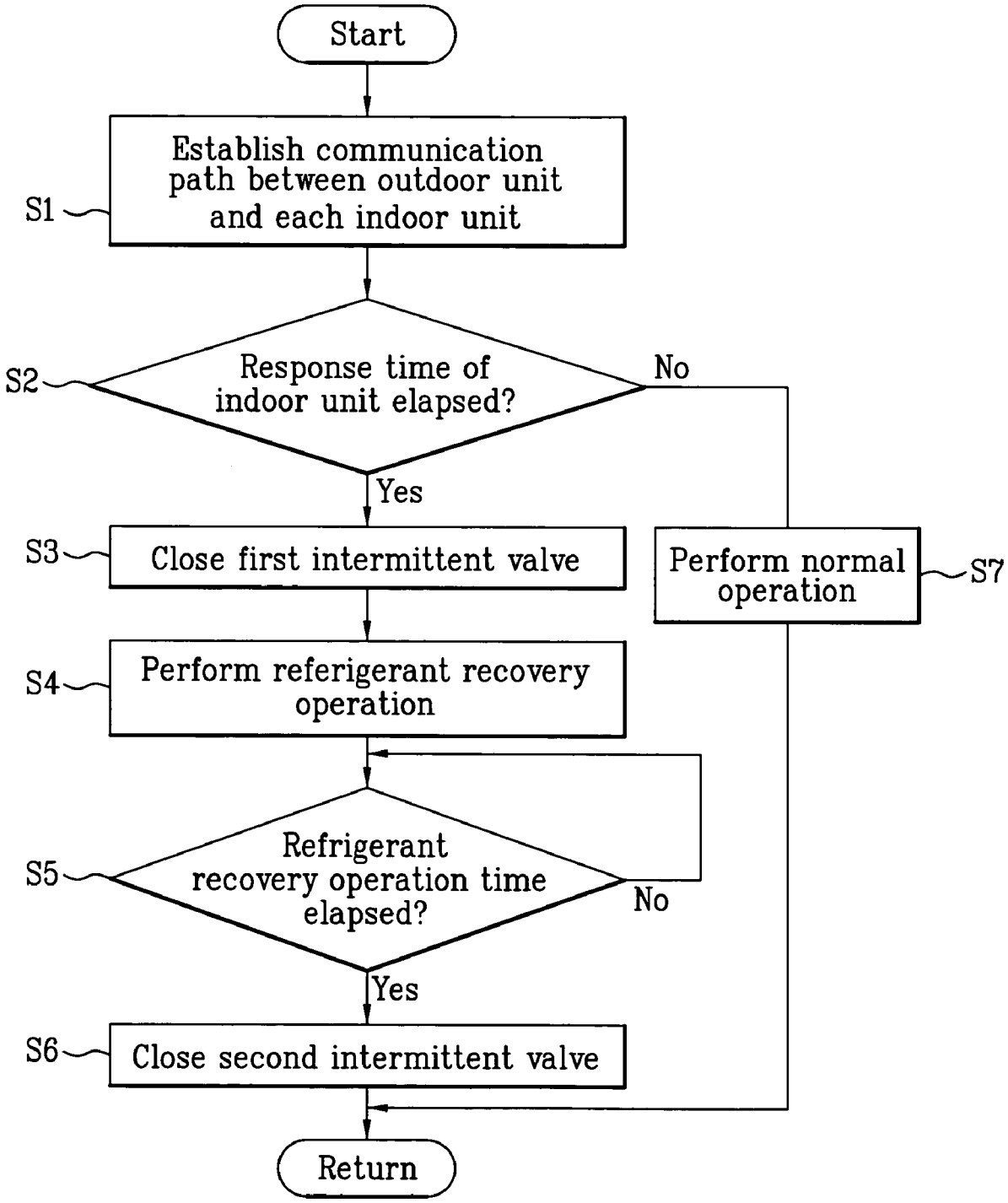
FIG. 3 is a flow chart illustrating a method for controlling indoor units of a multi-unit air conditioner in accordance with the present invention.

Hereinafter, a method for controlling the indoor units of the multi-unit air conditioner having the above-described configuration in accordance with an embodiment of the present invention will be described with reference to FIG. 3.

The control method according to the illustrated embodiment of the present invention includes the steps of (S1) establishing a communication path between the outdoor unit 40 and each of the indoor units 10, 20, and 30, (S2) determining whether or not there is a powered-off one of the indoor units 10, 20, and 30, (S5), if a powered-off indoor unit is present, recovering a refrigerant from the powered-off indoor unit, and (S6) cutting off the refrigerant supplied to the powered-off indoor unit after completion of the refrigerant recovery.

At the determination step S2, the indoor unit or indoor units, which do not provide a response to the outdoor unit 40 for a predetermined response time (for example, 5 minutes), are determined to be in a powered-off state.

After execution of the determination step S2, the first intermittent valve 55*a* of the powered-off indoor unit or each of the powered-off indoor units is closed (S4). Subsequently, a refrigerant recovery operation is executed for a predetermined time (for example, 3 minutes). On the other hand, the powered-on indoor unit or indoor units are continuously normally operated (S7).

After the refrigerant is completely recovered from the powered-off indoor unit or indoor units (S5), the first intermittent valve 55*a* and second intermittent valve 55*b* associated with the powered-off indoor unit or each of the powered-off indoor units are closed (S6), so as to cut off refrigerant flows respectively introduced into and discharged from the associated indoor unit.

Since the introduction and discharge of the refrigerant into and from the powered-off indoor unit or indoor units are prevented, the remaining indoor unit or indoor units, which are in operation, can operate normally without any influence by the powered-off indoor unit or indoor units.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A multi-unit air conditioner comprising:

a plurality of indoor units each comprising a power controller adapted to independently power on or off an associated one of the indoor units;

an outdoor unit connected with the indoor units, the outdoor unit comprising a microcomputer for controlling an operation of the outdoor unit, and enabling the outdoor unit to communicate with the indoor units;

at least one controller for determining whether each of the indoor units is in an operation state or in a non-operation state, and controlling an operation of a distributor in accordance with the result of the determination;

a refrigerant line connected to the outdoor unit;

branch refrigerant lines connected between the refrigerant line and the plurality of indoor units;

sub electronic expansion valves respectively arranged in the branch refrigerant lines; and a main electronic expansion valve arranged in the refrigerant line, and a plurality of first valves provided in the respective branch refrigerant lines, wherein the at least one controller controls at least one of the plurality of first valves to be closed when a corresponding indoor unit is determined to be in the non-operation state, and controls the corresponding indoor unit to be operated for a predetermined period of time after the closing of at least one of the plurality of first valves.

2. The multi-unit air conditioner according to claim 1, wherein the at least one controller is installed in at least one of the outdoor unit and the distributor, respectively.

3. The multi-unit air conditioner according to claim 1, further comprising:

at least one second valve arranged in a refrigerant line through which the refrigerant from the indoor units is discharged into the outdoor unit.

4. The multi-unit air conditioner according to claim 3, wherein each of the first and second valves is a solenoid valve controlled by the controller.

5. The multi-unit air conditioner according to claim 3, wherein each of the first and second valves is a solenoid valve controlled by the microcomputer of the outdoor unit.

6. The multi-unit air conditioner according to claim 3, wherein:

the at least one second valve comprises a plurality of second valves respectively arranged in branch refrigerant lines, through each of which the refrigerant from an associated one of the indoor units is discharged into the outdoor unit.

7. A multi-unit air conditioner comprising:

a plurality of indoor units;

an outdoor unit connected with the indoor units, the outdoor unit comprising a microcomputer for controlling an operation of the outdoor unit, and enabling the outdoor unit to communicate with the indoor units;

an electronic expansion valve arranged in a refrigerant line through which a refrigerant from the outdoor unit is introduced into the indoor units;

first valves arranged in a refrigerant line through which the refrigerant is introduced into the indoor units;

second valves arranged in a refrigerant line through which the refrigerant from the indoor units is discharged into the outdoor unit; and at least one controller for determining whether each of the indoor units is in an operation state or in a non-operation state, and controlling an operation of a distributor in accordance with the result of the determination, the at least one controller being arranged in at least one of the outdoor unit and a distributor, respectively, wherein the electronic expansion valve comprises:

sub electronic expansion valves respectively arranged in branch refrigerant lines, through each of which the refrigerant is introduced into an associated one of the indoor units; and a main electronic expansion valve arranged in the refrigerant line, through which the refrigerant is introduced into the indoor units, and which is branched into the branch refrigerant lines wherein at least one of the first valves is controlled to be closed when a corresponding indoor unit is determined to be in the non-operation state, and the corresponding indoor unit is controlled to be operated for a predetermined period of time after the closing of the at least one of the first valves.

8. The multi-unit air conditioner according to claim 7, wherein each of the first valves is arranged between an associated one of the sub electronic expansion valves and the indoor unit associated with the associated sub electronic expansion valve.

9. The multi-unit air conditioner according to claim 7, wherein the electronic expansion valve and the first and second valves are controlled by the microcomputer of the outdoor unit.

10. The multi-unit air conditioner according to claim 7, wherein the electronic expansion valve and the first and second valves are controlled by the controller.

11. The multi-unit air conditioner according to claim 7, wherein each of the first and second valves is a solenoid valve controlled by the controller.

12. A multi-unit air conditioner comprising:

a plurality of indoor units;

an outdoor unit connected with the indoor units;

at least one controller for determining whether each of the indoor units is in an operation state or in a non-operation state, and controlling an operation of a distributor in accordance with the result of the determination;

refrigerant lines connected between the indoor units and the outdoor unit to allow refrigerant to flow from the outdoor unit to the respective indoor units; and valves arranged in the respective refrigerant lines, wherein the at least controller controls at least one of the valves to be closed when the corresponding indoor unit is determined to be in the non-operation state, and controls the corresponding indoor unit to be operated for a predetermined period of time after the closing of the at least one of the valves.

* * * * *